US008439531B2

(12) United States Patent
Trott et al.

(10) Patent No.: US 8,439,531 B2
(45) **Date of Patent: *May 14, 2013**

(54) LIGHTING ASSEMBLIES AND COMPONENTS FOR LIGHTING ASSEMBLIES

(75) Inventors: Gary David Trott, Morrisville, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 429 days.

This patent is subject to a terminal disclaimer.

(21) Appl. No.: 11/939,059

(22) Filed: Nov. 13, 2007

(65) Prior Publication Data

US 2008/0112170 A1 May 15, 2008

Related U.S. Application Data

(60) Provisional application No. 60/859,013, filed on Nov. 14, 2006.

(51) Int. Cl.
*F21V 15/00* (2006.01)
*F21V 17/00* (2006.01)

(52) U.S. Cl.
USPC ..... 362/364; 362/147; 362/249.02; 362/800

(58) Field of Classification Search ..... 362/147, 362/249.02, 294, 364, 373, 800
See application file for complete search history.

(56) References Cited

U.S. PATENT DOCUMENTS

| | | | | |
|---|---|---|---|---|
| 3,052,749 | A | 9/1962 | Milton et al. | |
| 3,263,023 | A | 7/1966 | Staley | |
| 4,689,442 | A | 8/1987 | Ozaki | |
| 5,116,689 | A | 5/1992 | Castro et al. | |
| 5,850,126 | A | 12/1998 | Kanbar | |
| 5,876,831 | A | 3/1999 | Rawal | |
| 6,045,240 | A | 4/2000 | Hochstein | |
| 6,184,628 | B1 * | 2/2001 | Ruthenberg | 315/185 R |
| 6,278,607 | B1 | 8/2001 | Moore et al. | |
| 6,340,868 | B1 | 1/2002 | Lys et al. | |
| 6,350,043 | B1 | 2/2002 | Gloisten | |
| 6,441,943 | B1 | 8/2002 | Roberts et al. | |

(Continued)

FOREIGN PATENT DOCUMENTS

| | | |
|---|---|---|
| EP | 1 174 307 | 1/2002 |
| EP | 1 600 691 | 11/2005 |

(Continued)

OTHER PUBLICATIONS

Cree, Inc., "Cree® Xlamp® 7090 XR-E Series LED Binning and Labeling," Application Note: CLD-AP08.000, 7pp (2006).

(Continued)

*Primary Examiner* — Jason Moon Han
(74) *Attorney, Agent, or Firm* — Burr & Brown

(57) ABSTRACT

A lighting assembly, comprising a light engine assembly and a room-side element. The room-side element is in contact with the light engine assembly. The light engine assembly comprises at least one trim element and a light engine. The trim element defines a trim element internal space. The light engine comprises at least one solid state light emitter, and is positioned within the trim element internal space. Also, a lighting assembly, comprising a light engine assembly and means for dissipating heat from the light engine assembly.

26 Claims, 6 Drawing Sheets

U.S. PATENT DOCUMENTS

| | | | |
|---|---|---|---|
| 6,482,520 | B1 | 11/2002 | Tzeng |
| 6,578,986 | B2 | 6/2003 | Swaris et al. |
| 6,659,632 | B2 | 12/2003 | Chen |
| 6,712,486 | B1 | 3/2004 | Popovich et al. |
| 6,740,972 | B2 | 5/2004 | Smith et al. |
| 6,788,541 | B1 | 9/2004 | Hsiung |
| 6,789,921 | B1 | 9/2004 | Deloy et al. |
| 6,791,257 | B1 | 9/2004 | Sato et al. |
| 6,800,932 | B2 | 10/2004 | Lam et al. |
| 6,805,474 | B2 | 10/2004 | Walser et al. |
| 6,846,093 | B2 | 1/2005 | Swaris et al. |
| 6,864,573 | B2 | 3/2005 | Robertson et al. |
| 6,880,954 | B2 | 4/2005 | Ollet et al. |
| 6,949,772 | B2 | 9/2005 | Shimizu et al. |
| 7,014,336 | B1 | 3/2006 | Ducharme et al. |
| 7,030,486 | B1 | 4/2006 | Marshall |
| 7,095,110 | B2 | 8/2006 | Arik et al. |
| 7,121,688 | B2 | 10/2006 | Rempel |
| 7,144,140 | B2 | 12/2006 | Sun et al. |
| 7,210,832 | B2 | 5/2007 | Huang |
| 7,213,940 | B1 | 5/2007 | Van De Ven et al. |
| 7,226,189 | B2 | 6/2007 | Lee et al. |
| 7,234,844 | B2 | 6/2007 | Bolta et al. |
| 7,258,475 | B2 | 8/2007 | Kurumatani |
| 7,284,874 | B2 | 10/2007 | Jeong et al. |
| 2003/0218878 | A1 | 11/2003 | Swaris et al. |
| 2004/0105247 | A1 | 6/2004 | Calvin et al. |
| 2005/0051789 | A1 | 3/2005 | Negley et al. |
| 2005/0077525 | A1 | 4/2005 | Lynch et al. |
| 2005/0094105 | A1 | 5/2005 | Otsuka et al. |
| 2005/0111234 | A1 | 5/2005 | Martin et al. |
| 2005/0128751 | A1 | 6/2005 | Robarge et al. |
| 2005/0168986 | A1 | 8/2005 | Wegner |
| 2005/0174780 | A1 | 8/2005 | Park |
| 2005/0237739 | A1 | 10/2005 | Lee et al. |
| 2006/0061539 | A1 | 3/2006 | Song et al. |
| 2006/0098440 | A1 | 5/2006 | Allen |
| 2006/0187660 | A1 | 8/2006 | Liu |
| 2007/0074755 | A1 | 4/2007 | Eberspacher et al. |
| 2007/0137074 | A1 | 6/2007 | Van de Ven |
| 2007/0139920 | A1 | 6/2007 | Van de Ven |
| 2007/0139923 | A1 | 6/2007 | Negley |
| 2007/0170447 | A1 | 7/2007 | Negley |
| 2007/0171145 | A1 | 7/2007 | Coleman |
| 2007/0236911 | A1 | 10/2007 | Negley |
| 2007/0247414 | A1 | 10/2007 | Roberts |
| 2007/0247847 | A1 | 10/2007 | Villard |
| 2007/0247851 | A1 | 10/2007 | Villard |
| 2007/0262337 | A1 | 11/2007 | Villard |
| 2007/0263393 | A1 | 11/2007 | Van de Ven |
| 2007/0267983 | A1 | 11/2007 | Van de Ven |
| 2007/0274063 | A1 | 11/2007 | Negley |
| 2007/0274080 | A1 | 11/2007 | Negley |
| 2007/0278503 | A1 | 12/2007 | Van de Ven |
| 2007/0278934 | A1 | 12/2007 | Van de Ven |
| 2007/0279440 | A1 | 12/2007 | Negley |
| 2007/0279903 | A1 | 12/2007 | Negley |
| 2007/0280624 | A1 | 12/2007 | Negley |
| 2008/0084685 | A1 | 4/2008 | Van de Ven |
| 2008/0084700 | A1 | 4/2008 | Van de Ven |
| 2008/0084701 | A1 | 4/2008 | Van de Ven |
| 2008/0088248 | A1 | 4/2008 | Myers |
| 2008/0089053 | A1 | 4/2008 | Negley |
| 2008/0106895 | A1 | 5/2008 | Van de Ven |
| 2008/0106907 | A1 | 5/2008 | Trott |
| 2008/0112168 | A1 | 5/2008 | Pickard |
| 2008/0130285 | A1 | 6/2008 | Negley |
| 2008/0136313 | A1 | 6/2008 | Van de Ven |
| 2008/0137347 | A1 | 6/2008 | Trott |
| 2008/0192493 | A1 | 8/2008 | Villard |
| 2008/0259589 | A1 | 10/2008 | Van de Ven |

FOREIGN PATENT DOCUMENTS

| | | |
|---|---|---|
| EP | 1 674 792 | 6/2006 |
| JP | S56-068912 U | 10/1954 |
| JP | H06-056920 U | 8/1994 |
| JP | 09-055457 | 2/1997 |
| JP | 11-264668 | 9/1999 |
| JP | 2001-036153 | 2/2001 |
| JP | 2001-075094 | 3/2001 |
| JP | 2004-182071 | 7/2004 |
| JP | 2005-158746 | 6/2005 |
| WO | 2008079161 | 7/2008 |

OTHER PUBLICATIONS

Cree, Inc., "Cree® Xlamp® 7090 XR-E Series LED Data Sheet," Datasheet: CLD-DS05.000, 10 pp (2006).

Cree, Inc., "Cree® Xlamp® 7090 XR-E Series LED Secondary Optics," Datasheet: CLD-DS07.000, 3 pp (2004-2006).

McMaster-Carr Supply Company, "Multipurpose Aluminum (Alloy 6061), specification sheets," Retrieved Dec. 14, 2006 from www.mcmaster.com/param/asp/Psearch2.asp?regTyp=parametric&act—psearch%F . . . , 3 pp.

Japanese Office Action (and translation provided by foreign counsel) from a corresponding Japanese patent application bearing a mailing date of Nov. 30, 2012.

* cited by examiner

LIGHTING ASSEMBLIES AND COMPONENTS FOR LIGHTING ASSEMBLIES

CROSS-REFERENCE TO RELATED APPLICATIONS

This application claims the benefit of U.S. Provisional Patent Application No. 60/859,013, filed Nov. 14, 2006, the entirety of which is incorporated herein by reference.

FIELD OF THE INVENTION(S)

The present inventive subject matter relates to lighting assemblies for use in lighting devices, and lighting devices which include such light engine assemblies. In some embodiments, the present inventive subject matter relates to lighting assemblies and lighting devices which include solid state light emitters, for example, light emitting diodes.

BACKGROUND OF THE INVENTION(S)

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction.

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Also, there is an ongoing need to provide lighting assemblies which can be installed and/or repaired more easily, with less modification of or damage to construction elements (e.g., ceilings, walls and floors) in which such lighting assemblies are mounted, and in which light emitters can be more easily changed.

Additionally, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide lighting assemblies (which include light emitting diodes or other solid state light emitters) which are improved, e.g., with respect to energy efficiency, color rendering index (CRI Ra), contrast, efficacy (lm/W), and/or duration of service.

Although the development of solid state light emitters, such as light emitting diodes, has in many ways revolutionized the lighting industry, some of the characteristics of light emitting diodes have presented challenges, some of which have not yet been fully met.

BRIEF SUMMARY OF THE INVENTION(S)

In the case of conventional recessed lighting and the like, a majority of the cans are sold for use in insulated ceilings. For example, residential recessed downlights are frequently installed in direct contact with insulation or in ceilings with little or no airflow. Most heat dissipates into the air of the room in which the downlight is installed.

The design of incandescent downlights has typically focused on maintaining the temperature of surfaces that come into contact with wood or insulation below maximum values, e.g., as specified by Underwriters Laboratories. Designers typically do not focus on the thermal management of the incandescent lamp because it is tolerant of the high temperatures typically found within incandescent downlights.

Conversely, the dissipation of heat from LEDs and other solid state light emitters within a recessed downlight is very critical. For instance, if LED junction temperatures are not maintained below manufacturers' ratings, decreased lamp life and compromised performance result.

The light engine assemblies according to the present inventive subject matter provide excellent heat dissipation, particularly in the room-side of the device. In one aspect of the present inventive subject matter, there are provided lighting assemblies which have increased surface area and mass where the lighting assembly extends into the room. In some embodiments of the present inventive subject matter, there is provided a lighting assembly which comprises a light engine assembly (a majority of which or the entirety of which is not in the room) and a room-side element which extends into the room and which includes structure which functions as a heat sink.

According to the present inventive subject matter, there is provided a lighting assembly, comprising a light engine assembly and a room-side element, in which the light engine assembly comprises at least one trim element which defines a trim element internal space, and a light engine comprising at least one solid state light emitter, the light engine being positioned within the trim element internal space.

In some embodiments according to the present inventive subject matter, the trim element comprises a flange portion, the flange portion extending farther from an axis of the trim element than all other portions of the trim element, at least a portion of the room-side element being in contact with at least a portion of the flange portion. In some such embodiments, the flange portion extends in a plane which is substantially perpendicular to an axis of the trim element.

In some embodiments according to the present inventive subject matter, the room-side element comprises a plurality of heat dissipating fins. In some such embodiments:

- at least one of the heat dissipating fins has at least one surface which is in a plane which is substantially perpendicular to an axis of the trim element, and/or
- the room-side element further comprises at least one heat conducting element positioned between the trim element and the room-side element.

In some embodiments according to the present inventive subject matter, the room-side element comprises an annular region and a plurality of heat dissipating fins, the heat dissipating fins extending away from the annular region such that any planar section which includes an axis of the trim element extends through at least some of the heat dissipating fins, and within any planar section, at least some of the heat dissipating fins extend radially from the annular region and define different angles relative to a plane which is perpendicular to the axis of the trim element.

In some embodiments according to the present inventive subject matter, any planar section which includes an axis of the trim element includes at least a first heat dissipating fin which extends from the trim element in a direction substantially parallel to the axis of the trim element, and at least two other heat dissipating fins which are substantially parallel with each other.

In some embodiments according to the present inventive subject matter, the room-side element comprises a heat sink structure and at least one solid state light emitter.

In some embodiments according to the present inventive subject matter, the room-side element comprises an annular element, the annular element having a plurality of concave portions in a first surface of the annular element which first surface is opposite to a second surface of the annular element, the second surface being in contact with the trim element, at least one solid state light emitter being positioned in each of at least some of the concave portions.

In some embodiments according to the present inventive subject matter:

the room-side element comprises at least one solid state light emitter; and any planar section which includes an axis of the trim element includes (1) at least a first heat dissipating fin which extends from the trim element in a direction substantially parallel to an axis of the trim element and (2) at least two other heat dissipating fins which are substantially parallel with each other.

In some embodiments according to the present inventive subject matter:

the light engine assembly further comprises a light engine housing positioned within the trim element internal space, the light engine housing defining a light engine housing internal space, and the light engine is positioned within the light engine housing internal space. In some such embodiments:

an external surface of the light engine housing is in contact with an internal surface of the trim element;

the light engine assembly further comprises at least one thermal interface element, the thermal interface element being positioned between and in contact with each of an external surface of the light engine housing and an internal surface of the trim element; and/or the light engine assembly further comprises a plurality of light engine housing fins (which may or may not be integral with the light engine housing), each of the light engine housing fins being (1) in contact with an external surface of the light engine housing, (2) in contact with an internal surface of the trim element, (3) outside of the light engine housing internal space, and (4) inside the trim element internal space.

In some embodiments according to the present inventive subject matter:

the lighting assembly further comprises at least a first light diffuser, the light diffuser is positioned within the trim element internal space, the trim element and the first light diffuser together define a trim element-diffuser internal space, and the light engine is positioned within the trim element-diffuser internal space.

In some embodiments according to the present inventive subject matter, the lighting assembly further comprises a lighting device housing, the lighting device housing defining a lighting device housing internal space, at least a portion of the light engine assembly being positioned within the lighting device housing internal space.

The lighting assemblies of the present inventive subject matter include unique heat dissipation structure extending from the trim element to increase the surface area and mass of the assembly, and enable heat dissipation through convective cooling with room air.

The inventive subject matter may be more fully understood with reference to the accompanying drawings and the following detailed description of the inventive subject matter.

DETAILED DESCRIPTION OF THE INVENTION(S)

Figure 1:
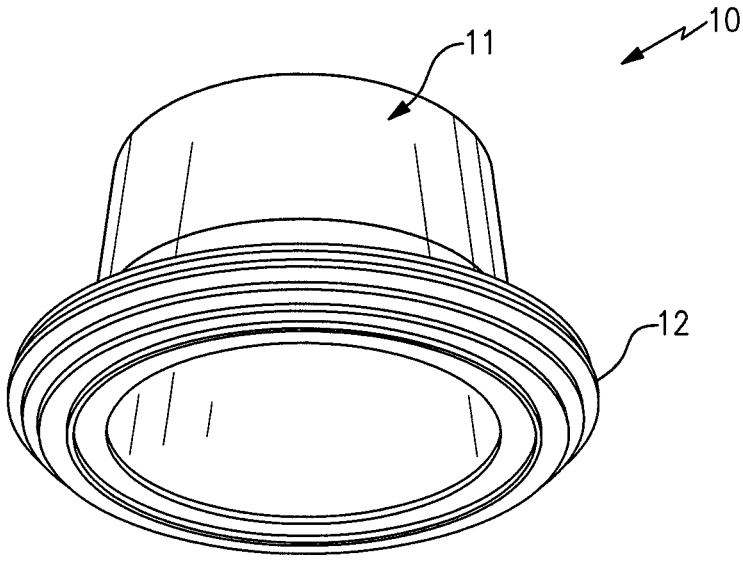
FIG. 1 is a perspective view of a first embodiment of a lighting assembly in accordance with the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

A statement herein that two components in a device are "electrically connected," means that there are no components electrically between the components, the insertion of which materially affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board or another medium, are electrically connected.

The expression "in contact", as used in the present specification, means that the first structure which is "in contact" with a second structure can be in direct contact with the second structure, or can be separated from the second structure by one or more intervening structures (i.e., in indirect contact), where the first and second structures, and the one or more intervening structures each have at least one surface which is in direct contact with another surface selected from among surfaces of the first and second structures and surfaces of the one or more intervening structures.

The expression "in direct contact", as used in the present specification, means that the first structure which is "in direct contact" with a second structure is touching the second structure and there are no intervening structures between the first and second structures at least at some location.

As used herein, the term "substantially," e.g., in the expressions "substantially perpendicular", "substantially parallel", "substantially cylindrical", "substantially frustoconical", "substantially conical", "substantially semi-elliptical", etc., means at least about 95% correspondence with the feature recited, e.g., the expression "substantially perpendicular", as used herein, means that at least 95% of the points in the structure which is characterized as being substantially perpendicular to a reference plane or line are located on one of or between a pair of planes (1) which are perpendicular to the reference plane, (2) which are parallel to each other and (3) which are spaced from each other by a distance of not more than 5% of the largest dimension of the structure;

the expression "substantially parallel" means that two lines (or two planes) diverge from each other at most by an angle of 5% of 90 degrees, i.e., 4.5 degrees;

the expression "substantially cylindrical", as used herein, means that at least 95% of the points in the surface which is characterized as being substantially cylindrical are located on one of or between a pair of imaginary cylindrical structures which are spaced from each other by a distance of not more than 5% of their largest dimension;

the expression "substantially frustoconical", as used herein, means that at least 95% of the points in the surface which is characterized as being substantially frustoconical are located on one of or between a pair of imaginary frustoconical structures which are spaced from each other by a distance of not more than 5% of their largest dimension;

the expression "substantially conical", as used herein, means that at least 95% of the points in the surface which is characterized as being substantially conical are located on one of or between a pair of imaginary conical structures which are spaced from each other by a distance of not more than 5% of their largest dimension; and the expression "substantially semi-elliptical" means that a semi-ellipse can be drawn having the formula $x^2/a^2+y^2/b^2=1$, where $y \geqq 0$, and imaginary axes can be drawn at a location where the y coordinate of each point on the structure is within 0.95 to 1.05 times the value obtained by inserting the x coordinate of such point into such formula.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, the present inventive subject matter provides a lighting assembly comprising a light engine assembly and a room-side element, in which the light engine assembly comprises at least one trim element and a light engine comprising at least one solid state light emitter.

The trim element can be of any desired shape, and can be made of any desired material, a wide variety of both of which are well-known to persons skilled in the art. Representative examples of materials out of which the trim element can be made include rolled steel, spun aluminum, die cast aluminum, liquid crystal polymer, polyphenylene sulfide (PPS), thermoset bulk molded compound or other composite materials, which provide excellent heat transfer properties, which would assist in dissipating heat.

As noted above, the light engine comprises at least one solid state light emitter. In some embodiments, the light engine further comprises structure for supporting each of the at least one solid state light emitter and electrically conductive structures (e.g., a printed circuit board) which carry power from at least one power source (which interfaces with the light engine) to the at least one solid state light emitter. Representative examples of suitable light engines for use according to the present inventive subject matter are described in:

U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007 (now U.S. Patent Publication No. 2008/0084701), the entireties of which are hereby incorporated by reference; and U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard), the entirety of which is hereby incorporated by reference.

The one or more solid state light emitter can be any suitable solid state light emitter, a wide variety of which are well-known and readily available to persons skilled in the art. Solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made). The expression "solid state light emitter", as used herein, can refer to a component including one or more solid state light emitter or a component including one or more solid state light emitter as well as one or more lumiphor. In some embodiments according to the present inventive subject matter, a lighting assembly includes one or more solid state light emitters which include at least one solid state light emitter and at least one lumiphor which emits light, at least a portion of such light emitted by the luminescent element being emitted in response to luminescent material in the luminescent element being excited by light emitted by the at least one solid state light emitter.

As noted above, one type of solid state light emitter which can be employed are LEDs. Such LEDs can be selected from among any light emitting diodes (a wide variety of which are readily obtainable and well known to those skilled in the art, and therefore it is not necessary to describe in detail such devices, and/or the materials out of which such devices are made). For instance, examples of types of light emitting diodes include inorganic and organic light emitting diodes, a variety of each of which are well-known in the art.

Representative examples of such LEDs, many of which are known in the art, can include lead frames, lumiphors, encapsulant regions, etc.

Representative examples of suitable LEDs are described in:

(1) U.S. Patent Application No. 60/753,138, filed on Dec. 22, 2005, entitled "Lighting Device" (inventor: Gerald H. Negley) and U.S. patent application Ser. No. 11/614,180, filed Dec. 21, 2006 (now U.S. Patent Publication No. 2007/0236911), the entireties of which are hereby incorporated by reference;

(2) U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven) and U.S. patent application Ser. No. 11/624,811, filed Jan. 19, 2007 (now U.S. Patent Publication No. 2007/0170047), the entireties of which are hereby incorporated by reference;

(3) U.S. Patent Application No. 60/808,702, filed on May 26, 2006, entitled "Lighting Device" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference;

(4) U.S. Patent Application No. 60/808,925, filed on May 26, 2006, entitled "Solid State Light Emitting Device and Method of Making Same" (inventors: Gerald H. Negley and Neal Hunter) and U.S. patent application Ser. No. 11/753,103, filed May 24, 2007 (now U.S. Patent Publication No. 2007/280624), the entireties of which are hereby incorporated by reference;

(5) U.S. Patent Application No. 60/802,697, filed on May 23, 2006, entitled "Lighting Device and Method of Making" (inventor: Gerald H. Negley) and U.S. patent application Ser. No. 11/751,990, filed May 22, 2007 (now U.S. Patent Publication No. 2007/0274063), the entireties of which are hereby incorporated by reference;

(6) U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;

(7) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and (8) U.S. Patent Application No. 60/851,230, filed on Oct. 12, 2006, entitled "LIGHTING DEVICE AND METHOD OF MAKING SAME" (inventor: Gerald H. Negley, the entirety of which is hereby incorporated by reference.

Some embodiments according to the present inventive subject matter include at least a first LED and at least a first lumiphor. In some such embodiments, the light emitted from the first LED has a peak wavelength in a range of from 430 nm to 480 nm, and the light emitted from the first lumiphor has a dominant wavelength in a range of from about 555 nm to about 585 nm.

Some embodiments according to the present inventive subject matter include at least a first LED, at least a first lumiphor and at least a second LED. In some such embodiments, the light emitted from the first LED has a peak wavelength in a range of from 430 nm to 480 nm, and the light emitted from the first lumiphor has a dominant wavelength in a range of from about 555 nm to about 585 nm, and the light emitted from the second LED has a dominant wavelength in a range of from 600 nm to 630 nm.

Some embodiments according to the present inventive subject matter include at least a first solid state light emitter (which, in some such embodiments includes at least a first LED and at least a first lumiphor) which, if illuminated, emits light which has x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

In general, light of any number of colors can be mixed by the lighting assemblies according to the present inventive subject matter. Representative examples of blends of light colors are described in:

(1) U.S. Patent Application No. 60/752,555, filed Dec. 21, 2005, entitled "Lighting Device and Lighting Method" (inventors: Antony Paul Van de Ven and Gerald H. Negley) and U.S. patent application Ser. No. 11/613,714, filed Dec. 20, 2006 (now U.S. Patent Publication No. 2007/0139920), the entireties of which are hereby incorporated by reference;

(2) U.S. Patent Application No. 60/752,556, filed on Dec. 21, 2005, entitled "SIGN AND METHOD FOR LIGHTING" (inventors: Gerald H. Negley and Antony Paul van de Ven) and U.S. patent application Ser. No. 11/613,733, filed Dec. 20, 2006 (now U.S. Patent Publication No. 2007/0137074), the entireties of which are hereby incorporated by reference;

(3) U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference;

(4) U.S. Patent Application No. 60/793,518, filed on Apr. 20, 2006, entitled "LIGHTING DEVICE AND LIGHTING METHOD" (inventors: Gerald H. Negley and Antony Paul van de Ven) and U.S. patent application Ser. No. 11/736,799, filed Apr. 18, 2007 (now U.S. Patent Publication No. 2007/0267983), the entireties of which are hereby incorporated by reference;

(5) U.S. Patent Application No. 60/793,530, filed on Apr. 20, 2006, entitled "LIGHTING DEVICE AND LIGHTING METHOD" (inventors: Gerald H. Negley and Antony Paul van de Ven) and U.S. patent application Ser. No. 11/737,321, filed Apr. 19, 2007 (now U.S. Patent Publication No. 2007/0278503), the entireties of which are hereby incorporated by reference;

(6) U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference;

(8) U.S. Patent Application No. 60/868,986, filed on Dec. 7, 2006, entitled "LIGHTING DEVICE AND LIGHTING METHOD" (inventors: Antony Paul van de Ven and Gerald H. Negley), the entirety of which is hereby incorporated by reference;

(9) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and

(10) U.S. Patent Application No. 60/891,148, filed on Feb. 22, 2007, entitled "LIGHTING DEVICE AND METHODS OF LIGHTING, LIGHT FILTERS AND METHODS OF FILTERING LIGHT" (inventor: Antony Paul van de Ven, the entirety of which is hereby incorporated by reference.

The lighting assemblies according to the present inventive subject matter can comprise any desired number of solid state light emitters. For example, a lighting assembly according to the present inventive subject matter can include one or more light emitting diodes, can include 50 or more light emitting diodes, or can include 100 or more light emitting diodes, etc.

As indicated above, some embodiments of the lighting assemblies according to the present inventive subject matter can include lumiphors (i.e., luminescence region or luminescent element which comprises at least one luminescent material). The expression "lumiphor", as used herein, refers to any luminescent element, i.e., any element which includes a luminescent material.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear encapsulant material (e.g., epoxy-based, silicone-based, glass-based or metal oxide-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, in some embodiments, the room-side element comprises:

at least one heat dissipating fin;

an annular region;

at least one heat conducting element;

an annular element;

a heat sink structure; and/or at least one solid state light emitter.

The heat dissipating fins and the annular region can be of any respective desired shape, and can be respectively made of any suitable material, a wide variety of which are well-known and readily available. Representative examples of materials out of which the heat dissipating fins and/or the annular region can be made are extruded aluminum, die cast aluminum, liquid crystal polymer, polyphenylene sulfide (PPS), thermoset bulk molded compound or other composite materials, which provide excellent heat transfer properties, which would assist in dissipating heat generated by the light engine. In some embodiments, the heat dissipating fins are integral with the trim element and/or the annular region.

As noted above, in some embodiments of the present inventive subject matter, the room-side element comprises at least one heat conducting element positioned between the trim element and the room-side element.

The heat conducting element can be made of any suitable material, a wide variety of which are well-known and readily available. Representative examples of suitable materials for use as a heat conducting element include thermal epoxy, thermal grease and gap pads, suitable varieties of each of which are well-known by and readily available to persons skilled in the art.

As noted above, in some embodiments of the present inventive subject matter, the room-side element comprises an annular element which has a plurality of concave portions, at least one solid state light emitter being positioned in each of at least some of the concave portions.

The annular element can be made of any suitable material, a wide variety of which are well-known and readily available. Representative examples of materials out of which the annular element can be made include extruded aluminum, die cast aluminum, liquid crystal polymer, polyphenylene sulfide (PPS), thermoset bulk molded compound or other composite materials, which provide excellent heat transfer properties, which would assist in dissipating heat.

As noted above, in some embodiments of the present inventive subject matter, the room-side element comprises a heat sink structure.

The heat sink structure can be made of any suitable material, a wide variety of which are well-known and readily available. Representative examples of materials out of which the heat sink structure can be made include extruded aluminum, die cast aluminum, liquid crystal polymer, polyphenylene sulfide (PPS), thermoset bulk molded compound or other composite materials, which provide excellent heat transfer properties, which would assist in dissipating heat.

As noted above, in some embodiments of the present inventive subject matter, the room-side element comprises at least one solid state light emitter. The solid state light emitters which are described above as being suitable for use in the light engines according to the present inventive subject matter are equally suitable for use in the room-side elements according to the present inventive subject matter.

As noted above, in some embodiments of the present inventive subject matter, the light engine assembly further comprises a light engine housing.

The light engine housing can be made of any suitable material, a wide variety of which are well-known and readily available. Representative examples of materials out of which the light engine housing can be made are extruded aluminum, die cast aluminum, liquid crystal polymer, polyphenylene sulfide (PPS), thermoset bulk molded compound or other composite materials, which provide excellent heat transfer properties, which would assist in dissipating heat generated by the light engine.

The light engine housing can be any desired shape. Representative shapes for the light engine housing include substantially cylindrical and substantially frustoconical.

As noted above, in some embodiments of the present inventive subject matter, the light engine assembly further comprises at least one thermal interface element positioned between the light engine housing and the trim element.

The thermal interface element can be made of any suitable material, a wide variety of which are well-known and readily available. Representative examples of a suitable heat transfer materials include thermal epoxy, thermal grease and gap pads, suitable varieties of each of which are well-known by and readily available to persons skilled in the art.

As noted above, in some embodiments of the present inventive subject matter, the light engine assembly further comprises a plurality of light engine housing fins.

The light engine housing fins can be of any desired shape, and can be made of any suitable material, a wide variety of which are well-known and readily available. Representative examples of materials out of which the light engine housing can be made are extruded aluminum, die cast aluminum, liquid crystal polymer, polyphenylene sulfide (PPS), thermoset bulk molded compound or other composite materials, which provide excellent heat transfer properties, which would assist in dissipating heat generated by the light engine. In some embodiments, the light engine housing fins are integral with the light engine housing.

As noted above, in some embodiments according to the present inventive subject matter, there is further provided at least a first light diffuser.

Any desired light diffuser can be employed, if desired, and persons skilled in the art are familiar with and have easy access to a variety of such diffusers. In some embodiments of the present inventive subject matter, a diffuser is mounted below the light engine housing, whereby light emitted from the light engine passes through the diffuser and is diffused prior to exiting the lighting device into the region that will be illuminated by the lighting device, e.g., into a room. Alternatively or additionally, the lighting devices according to the present inventive subject matter can include a reflective element. Any desired reflective element can be employed, and persons skilled in the art are familiar with and have easy access to a variety of such reflective elements. A representative example of a suitable material out of which the reflective element can be made is a material marketed by Furukawa (a Japanese corporation) under the trademark MCPET®. In some embodiments of the present inventive subject matter, a reflective element is shaped and is positioned so as to cover at least part of the internal surface of the sidewall of the trim element. In some embodiments of the present inventive subject matter, a diffuser is provided and is mounted below the light engine housing, and a reflective element is provided and is mounted so as to cover the internal surface of the sidewall of the trim element (and/or the lighting device housing) below the diffuser.

As noted above, in some embodiments of the present inventive subject matter, the lighting assembly further comprises a lighting device housing (to provide a lighting device).

The lighting device housing, when included, can be formed of any material which can be molded and/or shaped, a wide variety of which are well-known and readily available. Preferably, the lighting device housing is formed of a material which is an effective heat sink (i.e., which has high thermal conductivity and/or high heat capacity) and/or which is reflective (or which is coated with a reflective material). A representative example of a material out of which the lighting device housing can be made is rolled steel.

The lighting device housing can be any desired shape. A representative shape for the lighting device housing is hollow substantially cylindrical, e.g., as in conventional "can" light fixtures. Other representative shapes include hollow conical (or substantially conical), hollow frustoconical (or substantially frustoconical) and hollow semi-elliptical (or substantially semi-elliptical), or any shape which includes one or more portions which are individually selected from among hollow conical (or substantially conical), hollow frustoconical (or substantially frustoconical), hollow cylindrical (or substantially cylindrical) and hollow semi-elliptical (or substantially semi-elliptical).

For example, housings which may be used as lighting device housings or light engine housings in practicing the present inventive subject matter, and light engines which may be used in practicing the present inventive subject matter are described in:

(1) U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference;

(2) U.S. Patent Application No. 60/798,446, filed on May 5, 2006, entitled "Lighting Device" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

(3) U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), and U.S. patent application Ser. No. 11/856,421, filed Sep. 17, 2007 (now U.S. Patent Publication No. 2008/0084700), the entireties of which are hereby incorporated by reference;

(4) U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007 (now U.S. Patent Publication No. 2008/0084701), the entireties of which are hereby incorporated by reference;

(5) U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153, filed May 30, 2007 (now U.S. Patent Publication No. 2007/0279903), the entireties of which are hereby incorporated by reference;

(6) U.S. Patent Application No. 60/858,881, filed on Nov. 14, 2006, entitled "LIGHT ENGINE ASSEMBLIES" (inventors: Paul Kenneth Pickard and Gary David Trott), the entirety of which is hereby incorporated by reference;

(7) U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard), the entirety of which is hereby incorporated by reference;

(8) U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference; and (9) U.S. Patent Application No. 60/916,384, filed on May 7, 2007, entitled "LIGHT FIXTURES, LIGHTING DEVICES, AND COMPONENTS FOR THE SAME" (inventors: Paul Kenneth Pickard, Gary David Trott and Ed Adams), the entirety of which is hereby incorporated by reference.

The lighting devices of the present inventive subject matter can be supplied with electricity in any desired manner. Skilled artisans are familiar with a wide variety of power supplying apparatuses, and any such apparatuses can be employed in connection with the present inventive subject matter. The lighting devices of the present inventive subject matter can be electrically connected (or selectively connected) to any desired power source, persons of skill in the art being familiar with a variety of such power sources.

In addition, any desired circuitry can be employed in order to supply energy to the lighting devices according to the present inventive subject matter. Representative examples of circuitry which may be used in practicing the present inventive subject matter is described in:

(1) U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference;

(2) U.S. Patent Application No. 60/798,446, filed on May 5, 2006, entitled "Lighting Device" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

(3) U.S. Patent Application No. 60/809,959, filed on Jun. 1, 2006, entitled "Lighting Device With Cooling" (inventors: Thomas G. Coleman, Gerald H. Negley and Antony Paul van de Ven) and U.S. patent application Ser. No. 11/626,483, filed Jan. 24, 2007 (now U.S. Patent Publication No. 2007/0171145), the entireties of which are hereby incorporated by reference;

(4) U.S. Patent Application No. 60/809,595, filed on May 31, 2006, entitled "LIGHTING DEVICE AND METHOD OF LIGHTING" (inventor: Gerald H. Negley) and U.S. patent application Ser. No. 11/755,162, filed May 30, 2007 (now U.S. Patent Publication No. 2007/0279440), the entireties of which are hereby incorporated by reference;

(5) U.S. Patent Application No. 60/844,325, filed on Sep. 13, 2006, entitled "BOOST/FLYBACK POWER SUPPLY TOPOLOGY WITH LOW SIDE MOSFET CURRENT CONTROL" (inventor: Peter Jay Myers), and U.S. patent application Ser. No. 11/854,744, filed Sep. 13, 2007 (now U.S. Patent Publication No. 2008/0088248), the entireties of which are hereby incorporated by reference.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosure (uniformly or non-uniformly).

The present inventive subject matter is further directed to an illuminated surface, comprising a surface and at least one lighting device as described herein, wherein if the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 2:
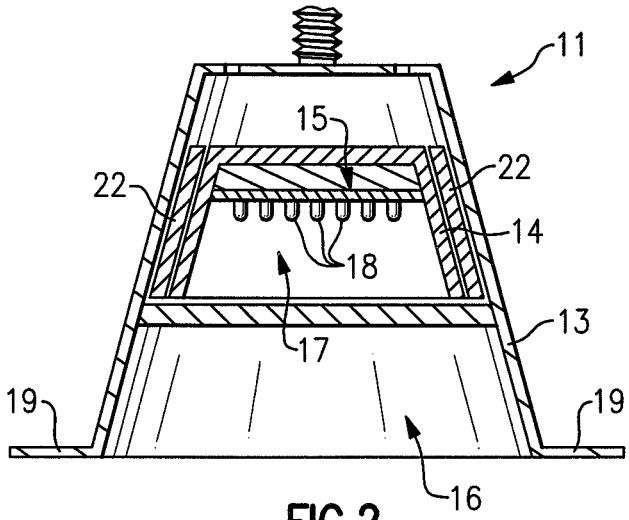
FIG. 2 is a sectional view of the light engine assembly 11 in the first embodiment depicted in FIG. 1.

FIGS. 1-4 depict a first embodiment of a lighting assembly in accordance with the present inventive subject matter. Referring to FIG. 1, there is shown a lighting assembly 10 which comprises a light engine assembly 11 and a room-side element 12 in contact with a portion of the light engine assembly 11. Referring to FIG. 2, the light engine assembly 11 comprises a trim element 13, a light engine housing 14 and a light engine 15. The trim element 13 defines a trim element internal space 16. The light engine housing 14 is positioned within the trim element internal space 16. The light engine housing 14 defines a light engine housing internal space 17. The light engine 15 is positioned within the light engine housing internal space 17 (and therefore is also within the trim element internal space 16) and comprises a plurality of LEDs 18. A thermal interface element 22 is positioned between the light engine housing 14 and the trim element 13

Figure 3:
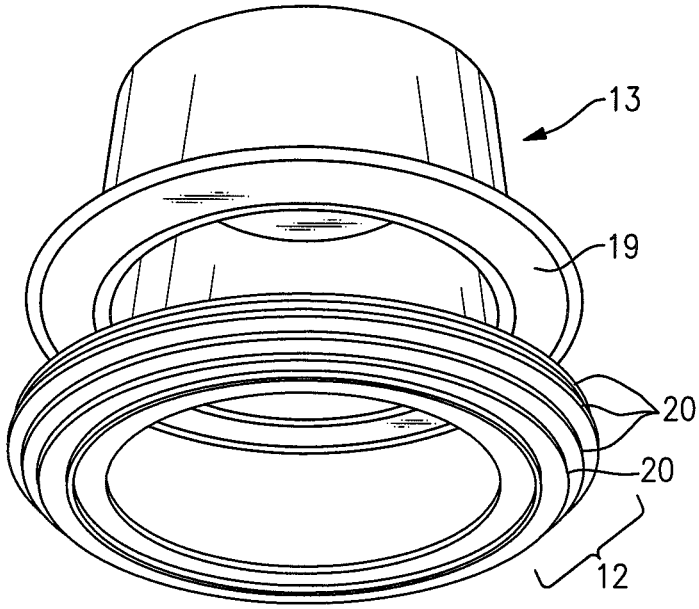
FIG. 3 is a perspective exploded view of the first embodiment depicted in FIG. 1.

The trim element 13 comprises a flange portion 19 which extends farther from an axis of the trim element 13 than all other portions of the trim element 13, and a surface of the room-side element 12 (see FIG. 1) is in contact with the flange portion 19. As seen in FIGS. 2 and 3, the flange portion 19 extends in a plane which is substantially perpendicular to an axis of the trim element 13.

Figure 4:
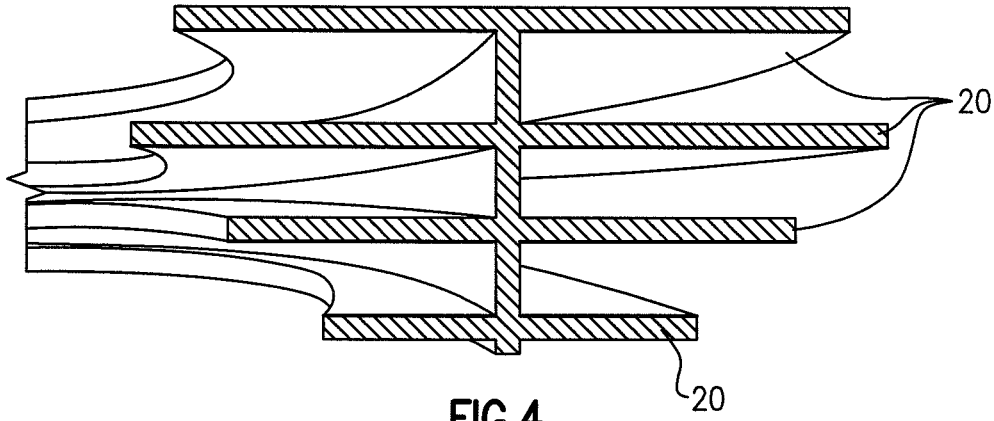
FIG. 4 is a partial sectional view of the room-side element 20 of the first embodiment depicted in FIG. 1.

As shown in FIG. 3, the room-side element 12 comprises a plurality of heat dissipating fins 20. FIG. 4 is a sectional view of the room-side element 12, and it shows the arrangement of the heat dissipating fins 20. As is evident from FIG. 4 (viewed in combination with FIG. 1), a plurality of heat dissipating fins 20 have surfaces in planes which are substantially perpendicular to an axis of the trim element.

Figure 5:
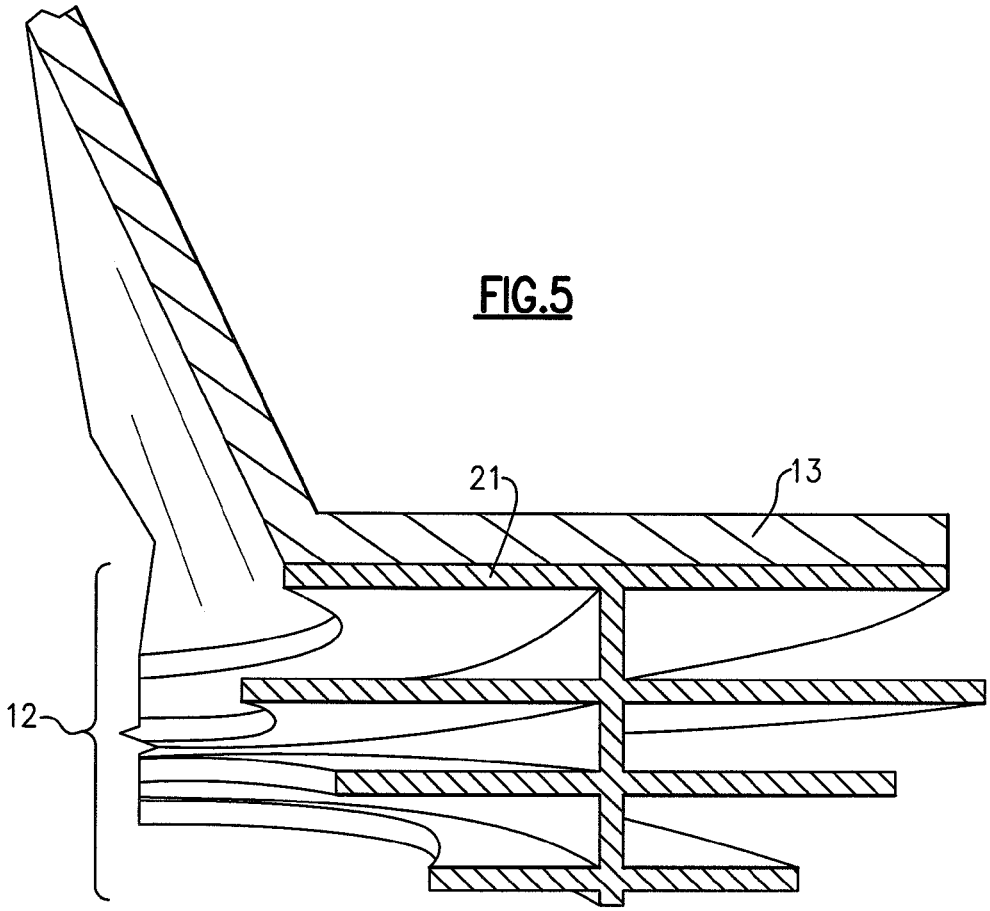
FIG. 5 is a partial sectional view of an alternative embodiment which includes a heat conducting element positioned between a trim element and a room-side element.

FIG. 5 is a partial sectional view of an alternative embodiment which includes a heat conducting element 21 positioned between a trim element 13 and a room-side element 12.

Figure 13:
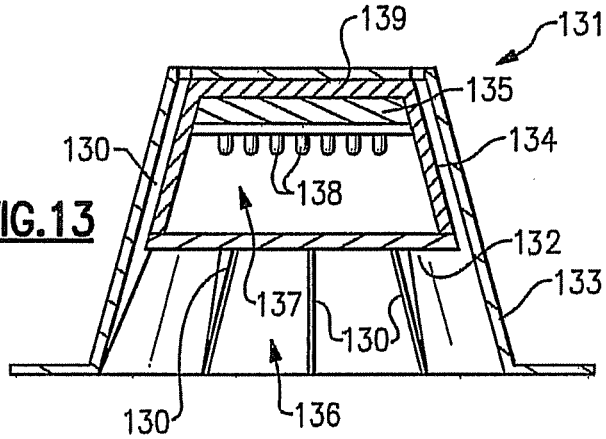
FIG. 13 is a sectional view of an alternative light engine assembly 131.

FIG. 13 depicts an alternative light engine assembly 131, which includes a trim element 133, a light engine housing 134 and a light engine 135. The trim element 133 defines a trim element internal space 136. The light engine housing 134 is positioned within the trim element internal space 136. The light engine housing 134 defines a light engine housing internal space 137. The light engine 135 is positioned within the light engine housing internal space 137 (and therefore is also within the trim element internal space 136) and comprises a plurality of LEDs 138. The light engine assembly 131 further includes a thermal interface element 139 positioned between and in contact with each of an external surface of the light engine housing 134 and an internal surface of the trim element 133. FIG. 13 also depicts a plurality of light engine housing fins 130, each of which is: (1) in contact with an external surface of the light engine housing 134 (and integral with the light engine housing 134), (2) in contact with an internal surface of the trim element 133, (3) outside of the light engine housing internal space 137, and (4) inside the trim element internal space 136.

FIG. 13 also depicts a diffuser 132 which is positioned within the trim element internal space 136, the trim element 133 and the diffuser 132 together defining a trim element-diffuser internal space, and the light engine 135 being positioned within the trim element-diffuser internal space.

FIG. 13 also depicts a diffuser 141 which is positioned within the trim element internal space 136, the trim element 133 and the diffuser 141 together defining a trim element-diffuser internal space, and the light engine 135 being positioned within the trim element-diffuser internal space.

Figure 6:
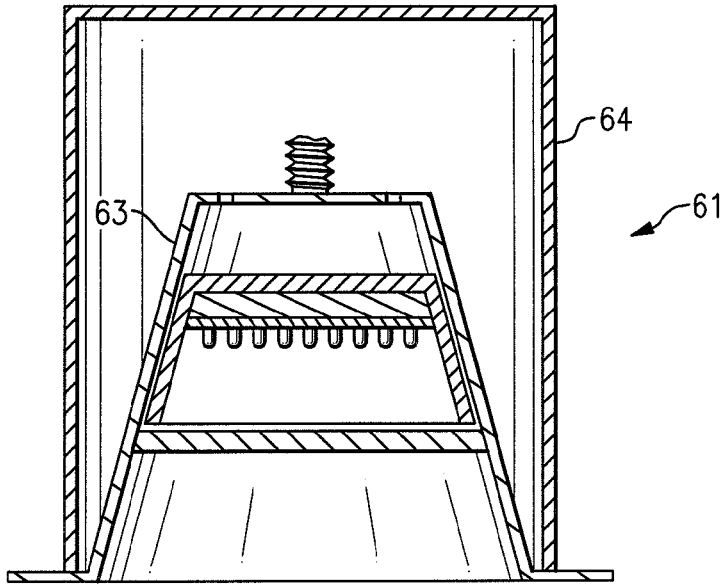
FIG. 6 is a partial sectional view of an alternative embodiment which is similar to the first embodiment and which further comprises a lighting device housing.

FIG. 6 is a sectional view of an alternative light engine assembly 61 which comprises a lighting device housing 64, the lighting device housing 64 defining a lighting device housing internal space within which the trim element 63 is positioned.

Figure 7:
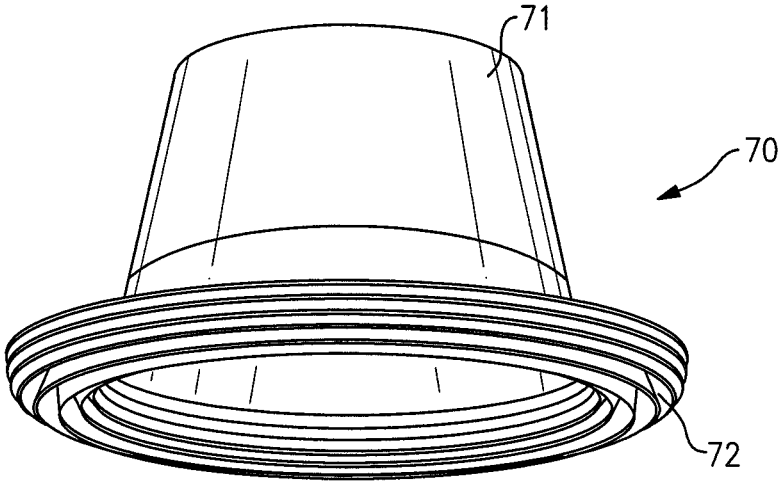
FIG. 7 is a perspective view of a second embodiment of a lighting assembly in accordance with the present inventive subject matter.
Figure 8:
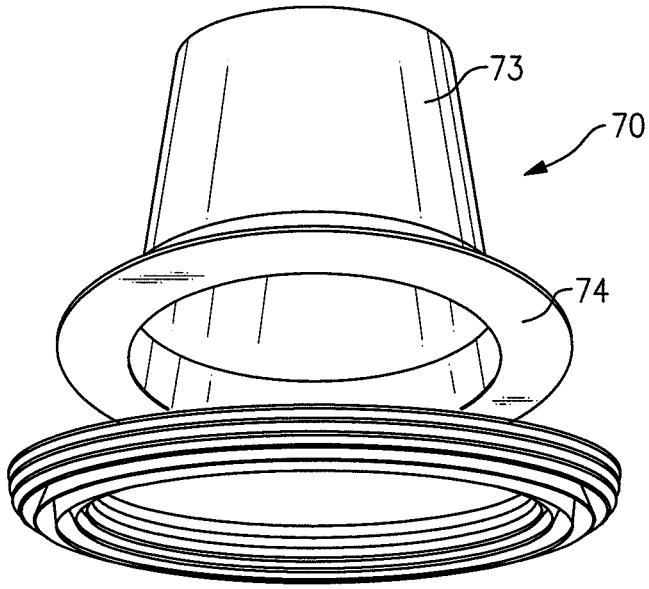
FIG. 8 is a perspective exploded view of the second embodiment depicted in FIG. 7.
Figure 9:
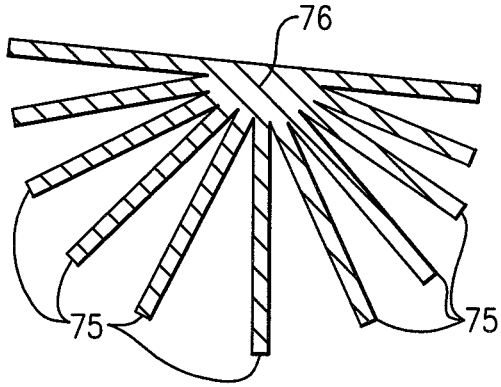
FIG. 9 is a partial sectional view of the room-side element of the second embodiment depicted in FIG. 7.

FIGS. 7-9 depict a second embodiment of a lighting assembly in accordance with the present inventive subject matter. Referring to FIG. 7, there is shown a lighting assembly 70 which comprises a light engine assembly 71 and a room-side element 72. Referring to FIG. 8, the light engine assembly 71 comprises a trim element 73 which comprises a flange portion 74.

FIG. 9 is a sectional view of the room-side element 72, and it shows the arrangement of the heat dissipating fins 75. As shown in FIG. 9, the room-side element 72 comprises an annular region 76 and the heat dissipating fins 75. As shown in FIG. 9, the heat dissipating fins extend away from the annular region 76 such that any planar section which includes an axis of the trim element 73 (e.g., the section shown in FIG. 9) extends through the heat dissipating fins 75, and within any of such planar sections, the heat dissipating fins 75 extend radially from the annular region 76 and define different angles relative to a plane which is perpendicular to the axis of the trim element 73.

Figure 10:
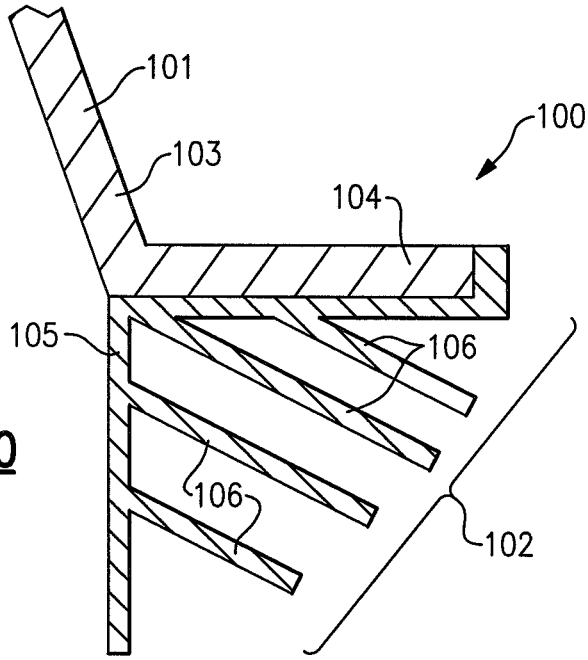
FIG. 10 is a partial sectional view of a third embodiment of a lighting assembly in accordance with the present inventive subject matter.

FIG. 10 is a sectional view of a portion of a third embodiment of a lighting assembly in accordance with the present inventive subject matter. Referring to FIG. 10, there is shown a lighting assembly 100 which comprises a light engine assembly 101 and a room-side element 102. The light engine assembly 101 comprises a trim element 103 which comprises a flange portion 104. The room-side element 102 comprises a first heat dissipating fin 105 which extends from the trim element 103 in a direction substantially parallel to an axis of the trim element 103, and four other heat dissipating fins 106 which extend such that any planar section which includes an axis of the trim element 103 (e.g., the section depicted in FIG. 10) extends through the heat dissipating fins 105, 106, and within any of such planar sections, the heat dissipating fins 106 are substantially parallel with each other.

Figure 11:
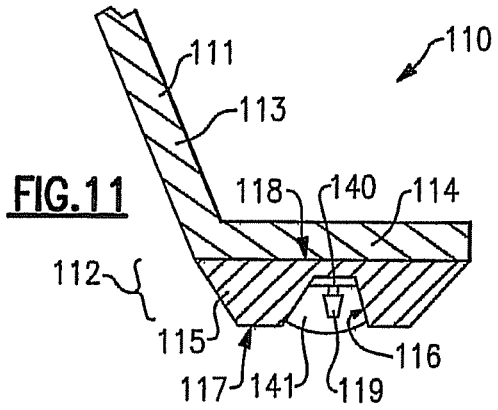
FIG. 11 is a partial sectional view of a fourth embodiment of a lighting assembly in accordance with the present inventive subject matter.

FIG. 11 is a sectional view of a fourth embodiment of a lighting assembly in accordance with the present inventive subject matter. Referring to FIG. 11, there is shown a lighting assembly 110 which comprises a light engine assembly 111 and a room-side element 112. The light engine assembly 111 comprises a trim element 113 which comprises a flange portion 114. The room-side element 112 comprises an annular element 115 (which functions as a heat sink structure), the annular element 115 having a plurality of concave portions 116 in a first surface 117 thereof, the first surface 117 being opposite to a second surface 118 of the annular element 115, the second surface 118 of the annular element 115 being in contact with the trim element 113. A solid state light emitter 119 is positioned in each of the concave portions 116. Alternatively, some or all of the concave portions can be substituted for with one or more annular trenches in which one or more solid state light emitters are positioned. An annular printed circuit board 140, which provides power to the solid state light emitters 119, is positioned within the annular element 115 (alternatively, more than one circuit board can be employed). The annular printed circuit board 140 is recessed into the annular element 115 to provide mechanical shielding, and a refractor 141 is included to increase diffusion and mixing. The solid state light emitters 119 can increase the amount of light delivered from the lighting assembly, and/or they can include RGB chips to create a color accent.

Figure 12:
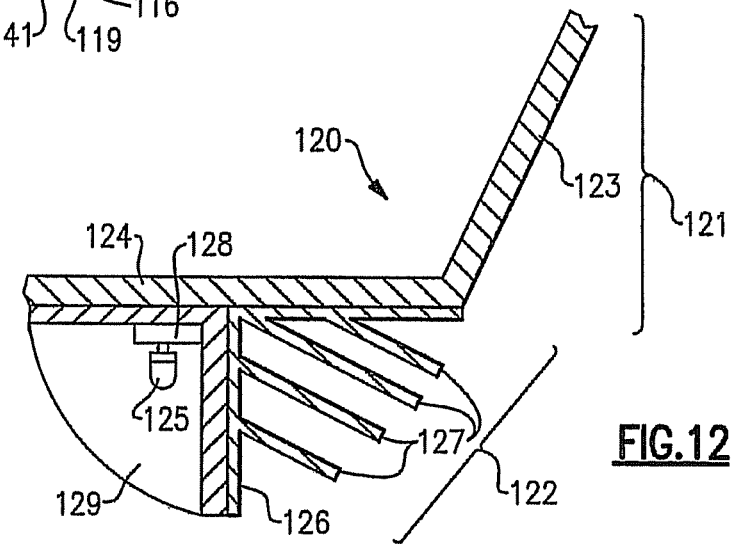
FIG. 12 is a partial sectional view of a fifth embodiment of a lighting assembly in accordance with the present inventive subject matter.

FIG. 12 is a sectional view of a fifth embodiment of a lighting assembly in accordance with the present inventive subject matter. Referring to FIG. 12, there is shown a lighting assembly 120 which comprises a light engine assembly 121 and a room-side element 122. The light engine assembly 121 comprises a trim element 123 which comprises a flange portion 124. The room-side element 122 comprises a plurality of solid state light emitters 125, and any planar section of the room-side element which includes an axis of the trim element 123 includes a first heat dissipating fin 126 which extends from the trim element 123 in a direction substantially parallel to the axis of the trim element 123, and four other heat dissipating fins 127 which are parallel with each other. The room-side element 122 also includes a printed circuit board 128 and a refractor 129.

Some embodiments of the light engine assemblies according to the present inventive subject matter are designed to be installed in typical recessed housings (cans) available from major fixture manufacturers.

Any two or more structural parts of the lighting assemblies described herein can be integrated. Any structural part of the lighting assemblies described herein can be provided in two or more parts (which are held together, if necessary). Similarly, any two or more functions can be conducted simultaneously, and/or any function can be conducted in a series of steps.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting assembly, comprising:

a light engine assembly; and a room-side element in contact with at least a portion of said light engine assembly, said room-side element comprising a plurality of heat-dissipating fins, said light engine assembly comprising:

at least one trim element, said trim element defining a trim element internal space;

a light engine housing within said trim element internal space, said light engine housing defining a light engine housing internal space; and a light engine comprising at least one solid state light emitter, said light engine within said light engine housing internal space, wherein said lighting assembly is configured to be mounted as a recessed light in an opening in a construction element having a room-side surface that defines a first plane, with an entirety of said room-side element on a first side of said first plane, and with said trim element internal space extending from a second side of said first plane at least to a portion of said opening, so that light emitted from said at least one solid state light emitter passes from said second side of said first plane to said first side of said first plane through said portion of said opening.

2. A lighting assembly as recited in claim 1, wherein said trim element comprises a flange portion, said flange portion extending farther from an axis of said trim element than all other portions of said trim element, at least a portion of said room-side element in contact with a first side of said flange portion, wherein said lighting assembly can be mounted in said construction element with a second side of said flange portion in contact with said construction element, with an entirety of said room-side element on the first side of said room-side surface, and with said trim element internal space on the second side of room-side surface.

3. A lighting assembly as recited in claim 2, wherein said flange portion extends in a plane which is substantially perpendicular to an axis of said trim element.

4. A lighting assembly as recited in claim 1, wherein at least one of said heat dissipating fins has at least one surface which is in a plane which is substantially perpendicular to an axis of said trim element.

5. A lighting assembly as recited in claim 1, wherein said lighting assembly further comprises at least one heat conducting element between said trim element and said room-side element.

6. A lighting assembly as recited in claim 1, wherein said room-side element comprises an annular region and at least two heat dissipating fins, said heat dissipating fins extending away from said annular region such that any planar section which includes an axis of said trim element extends through at least some of said heat dissipating fins, and within any said planar section, at least some of said heat dissipating fins extend radially from said annular region and define different angles relative to a plane which is perpendicular to said axis of said trim element.

7. A lighting assembly as recited in claim 1, wherein any planar section which includes an axis of said trim element extends through at least a first heat dissipating fin which extends in a direction substantially parallel to said axis of said trim element, and at least two other heat dissipating fins which are substantially parallel with each other.

8. A lighting assembly as recited in claim 1, wherein said room-side element comprises a heat sink structure and at least one solid state light emitter.

9. A lighting assembly as recited in claim 1, wherein said room-side element comprises an annular element, said annular element having a plurality of concave portions in a first surface of said annular element which first surface is opposite to a second surface of said annular element, said second surface in contact with said trim element, at least one solid state light emitter in each of at least some of said concave portions.

10. A lighting assembly as recited in claim 1, wherein:

said room-side element comprises at least one solid state light emitter; and any planar section which includes an axis of said trim element includes at least a first heat dissipating fin which extends in a direction substantially parallel to an axis of said trim element and at least two other heat dissipating fins which are substantially parallel with each other.

11. A lighting assembly as recited in claim 1, wherein an external surface of said light engine housing is in contact with an internal surface of said trim element.

12. A lighting assembly as recited in claim 1, wherein said light engine assembly further comprises at least one thermal interface element, said thermal interface element between and in contact with each of an external surface of said light engine housing and an internal surface of said trim element.

13. A lighting assembly as recited in claim 1, wherein said light engine assembly further comprises a plurality of light engine housing fins, each of said light engine housing fins:

in contact with an external surface of said light engine housing, in contact with an internal surface of said trim element, outside of said light engine housing internal space, and inside said trim element internal space.

14. A lighting assembly as recited in claim 13, wherein said light engine housing fins are integral with said light engine housing.

15. A lighting assembly as recited in claim 1, wherein:

said lighting assembly further comprises at least a first light diffuser, said light diffuser is within said trim element internal space, said trim element and said first light diffuser together define a trim element-diffuser internal space, and said light engine is within said trim element-diffuser internal space.

16. A lighting assembly as recited in claim 1, wherein said lighting assembly further comprises a lighting device housing, said lighting device housing defining a lighting device housing internal space, at least a portion of said light engine assembly within said lighting device housing internal space.

17. A lighting assembly, comprising:

a light engine assembly; and means for dissipating heat from said light engine assembly, said light engine assembly comprising:

at least one trim element, said trim element defining a trim element internal space;

a light engine housing within said trim element internal space, said light engine housing defining a light engine housing internal space; and a light engine comprising at least one solid state light emitter, said light engine within said light engine housing internal space, wherein said lighting assembly is configured to be mounted as a recessed light in an opening in a construction element having a room-side surface that defines a first plane, with an entirety of said means for dissipating heat on a first side of said first plane, and with said trim element internal space extending from a second side of said first plane at least to a portion of said opening, so that light emitted from said at least one solid state light emitter passes from said second side of said first plane to said first side of said first plane through said portion of said opening.

18. A lighting assembly as recited in claim 17, wherein said trim element comprises a flange portion, said flange portion extending farther from an axis of said trim element than all other portions of said trim element, said trim element in contact with a first side of said flange portion, wherein said lighting assembly can be mounted in said construction element with a second side of said flange portion in contact with said construction element, with said trim element internal space on one side of said room-side surface.

19. A lighting assembly as recited in claim 18, wherein said flange portion extends in a plane which is substantially perpendicular to an axis of said trim element.

20. A lighting assembly as recited in claim 17, wherein said means for dissipating heat comprises at least one recess, at least one solid state light emitter in said at least one recess.

21. A lighting assembly as recited in claim 17, wherein an external surface of said light engine housing is in contact with an internal surface of said trim element.

22. A lighting assembly as recited in claim 17, wherein said light engine assembly further comprises at least one thermal interface element, said thermal interface element between and in contact with each of an external surface of said light engine housing and an internal surface of said trim element.

23. A lighting assembly as recited in claim 17, wherein said light engine assembly further comprises a plurality of light engine housing fins, each of said light engine housing fins:

in contact with an external surface of said light engine housing, in contact with an internal surface of said trim element, outside of said light engine housing internal space, and inside said trim element internal space.

24. A lighting assembly as recited in claim 23, wherein said light engine housing fins are integral with said light engine housing.

25. A lighting assembly as recited in claim 17, wherein:

said lighting assembly further comprises at least a first light diffuser, said first light diffuser is within said trim element internal space, said trim element and said first light diffuser together define a trim element-diffuser internal space, and said light engine is within said trim element-diffuser internal space.

26. A lighting assembly as recited in claim 17, wherein said lighting assembly further comprises a lighting device housing, said lighting device housing defining a lighting device housing internal space, at least a portion of said light engine assembly within said lighting device housing internal space.

* * * * *